US006030287A

United States Patent [19]

Core

[11] Patent Number: 6,030,287

[45] Date of Patent: Feb. 29, 2000

[54] SYSTEM FOR DISTRIBUTING AIR THROUGH A CEILING IN A ROOM

[76] Inventor: William Roger Core, 1610 E. 55th Pl., Tulsa, Okla. 74105

[21] Appl. No.: 09/107,570

[22] Filed: Jun. 29, 1998

Related U.S. Application Data

[63] Continuation-in-part of application No. 08/821,096, Mar. 20, 1997, Pat. No. 5,795,220.

[51] Int. Cl.[7] ..... F24F 13/06

[52] U.S. Cl. ..... 454/292; 454/293; 454/295; 454/296; 454/298; 454/300

[58] Field of Search ..... 454/284, 285, 454/292, 293, 294, 295, 296, 297, 298, 300, 322, 329

[56] References Cited

U.S. PATENT DOCUMENTS

| | | | |
|---|---|---|---|
| Re. 33,347 | 9/1990 | Johnson, III | 454/292 |
| 165,721 | 7/1875 | Fritz | 424/322 |
| 2,837,991 | 6/1958 | DeRoo | 454/322 X |
| 3,760,708 | 9/1973 | Burup . | |
| 4,589,331 | 5/1986 | Villamagna et al. | 454/239 |
| 4,598,632 | 7/1986 | Johnson, III | 454/292 X |
| 4,810,207 | 3/1989 | Butterfiedl | 439/529 |
| 5,024,412 | 6/1991 | Hung et al. | 248/343 |
| 5,029,451 | 7/1991 | Imaiida et al. | 62/259.1 |
| 5,097,674 | 3/1992 | Imaiida et al. | 454/292 X |
| 5,564,980 | 10/1996 | Becker | 454/292 X |

FOREIGN PATENT DOCUMENTS

| | | | |
|---|---|---|---|
| 116940 | 5/1943 | Australia | 454/297 |
| 47254 | 3/1937 | France | 454/300 |
| 26 01 557 | 7/1977 | Germany | 454/292 |
| 2 155 170 | 9/1985 | United Kingdom | 454/297 |

*Primary Examiner*—Harold Joyce
*Attorney, Agent, or Firm*—Head, Johnson & Kachigian

[57] ABSTRACT

A system for distributing air through an opening in a ceiling into a room, the ceiling being supported by spaced apart joists or other ceiling structural members, the air being supplied by a duct located above the ceiling, including a plenum having an open top connected to the duct and an open bottom in communication with the ceiling opening. A support bar extends through the plenum and secured at its opposed ends to ceiling structural member. A motor hanger is secured to the support bar. An air diffuser is positioned in communication with the plenum open bottom. A fan motor is supported to the lower end of the motor hanger. A plurality of generally horizontally extending fan blades are attached to and rotated by the motor. Air is passed from the duct through the plenum and diffuser into the room, distribution of the air being augmented by the fan blades as rotated by the motor.

10 Claims, 8 Drawing Sheets

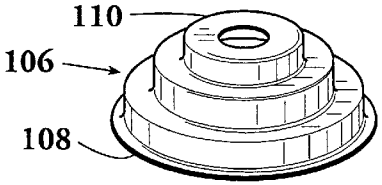
Fig. 8
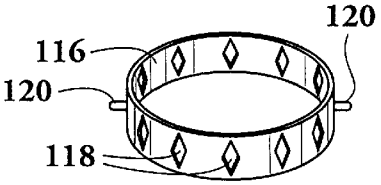
Fig. 10
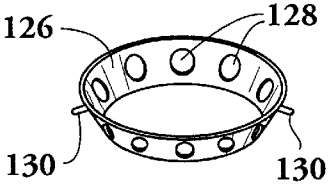
Fig. 11
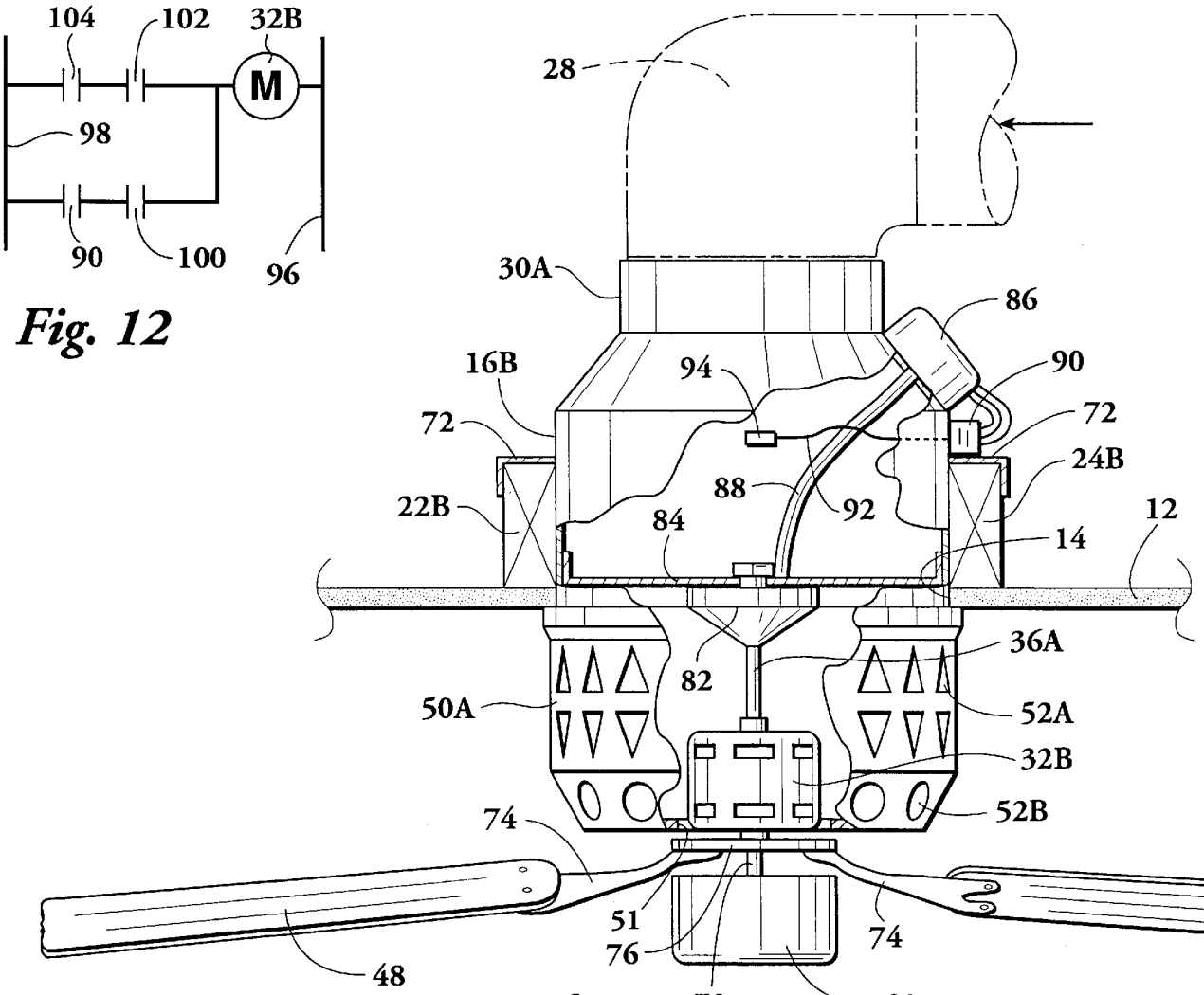
Fig. 6
Fig. 12

*Fig. 7*
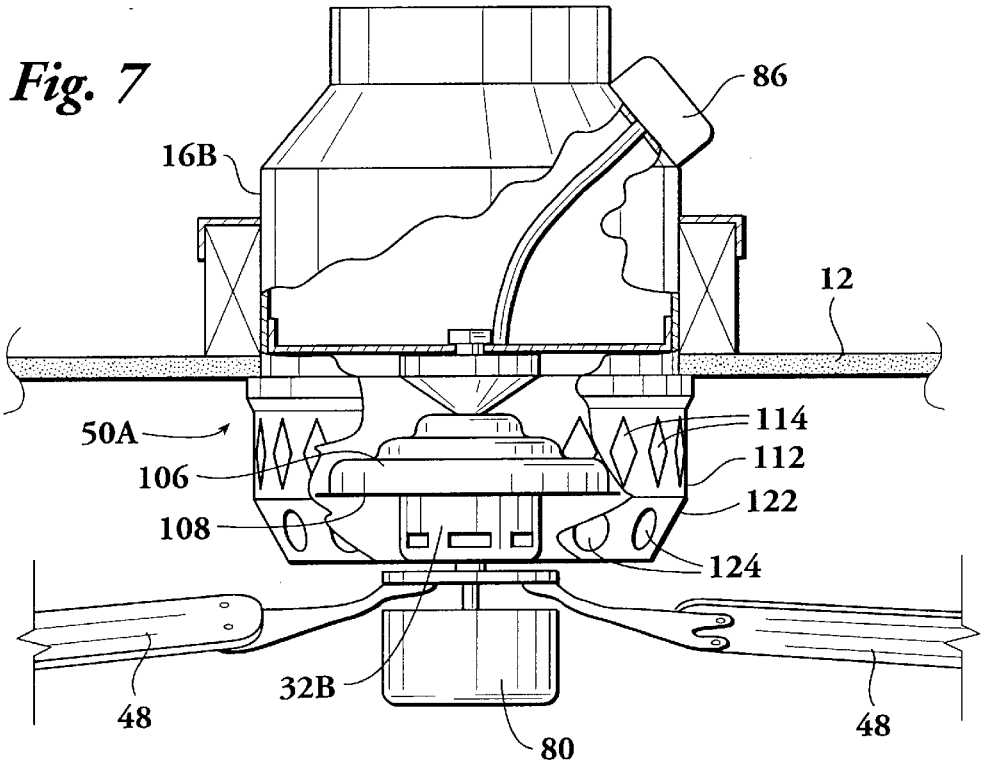
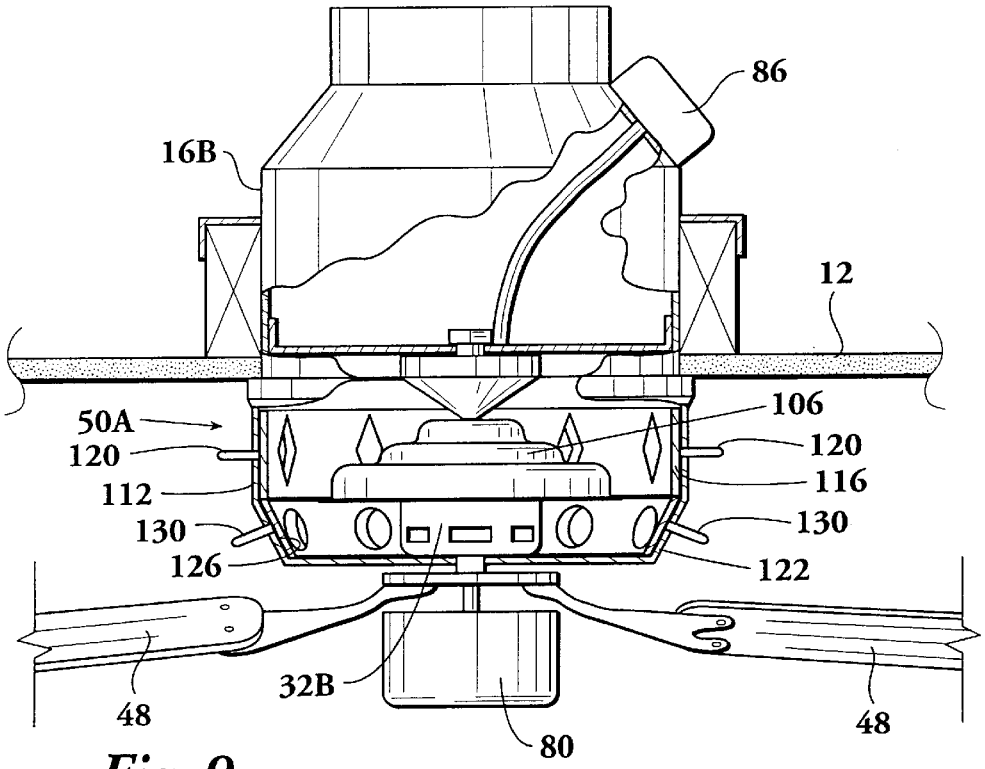
*Fig. 9*

154
156
158
146A
158
154
150A
132B
134

15
150A
132B
158
134
154
192
14A
186
142
141
200
14
178
198
146A
174
172
180
168
182
170
176
178
194
162
164
140
138
136
152
146B
144
154
156
134A
132B
150A
158
132A
134
134B
15
184
146A
158
156
154
158
134
154

184

SYSTEM FOR DISTRIBUTING AIR THROUGH A CEILING IN A ROOM

REFERENCE TO PENDING APPLICATIONS

This is a continuation-in-part of U.S. patent application Ser. No. 08/821,096, filed Mar. 20, 1997 U.S. Pat. No. 5,795,220 entitled "A CEILING FAN WITH AIR DIFFUSER".

REFERENCE TO MICROFICHE APPENDIX

This application is not referenced in any microfiche appendix.

BACKGROUND OF THE INVENTION

Heating, ventilation and air conditioning can be broken down into two types of systems, that is, a self contained system and a non-self container system. A self contained system is limited to a specific area, has its own manufactured purchase package components (blower, coil, duct work, inlet, outlet, etc.), and is independent from other sources. Some examples are window air conditioners, unit heaters, wall heaters, roof top package units, room fan powered package units, rest room ventilators, air curtain door fans, etc. A non-self contained system has a central primary air source (air handler or furnace with blower), serves a whole structure or building, is not limited to a specific area, and is made up of various manufactured components.

Most modern heating and/or air conditioning systems used in the world today are non-self contained systems and employ forced air circulation, that is, air is drawn from a room to be heated or cooled, passed through a heating and/or air conditioning system in which the air is heated or cooled and then distributed back through a duct work system to the room to thereby raise or lower the air temperature in the room according to comfort requirements. In some instances air is merely circulated in such system without heating or cooling to improve ventilation. While the air distribution system can be arranged to discharge forced air through the floor, or through a wall of a room, the most common practice is to discharge air, whether for heating, cooling or for ventilation, through the ceiling. A primary reason that discharge of air is made through the ceiling rather than through a floor or wall vent is that most building construction permits ready access to a ceiling compared to a floor or wall.

To distribute air from a forced air system through a ceiling the common practice is to utilize a ceiling vent which typically is designed to not only provide an opening through which air can pass through a ceiling into a room but also to aid in distribution of air in the room. A third desired aspect of a ceiling vent is to provide improved appearance, that is, to provide a way for air to enter a room that is other than simply a hole in the ceiling with which a forced air duct communicates. A covering placed in or over a hole in a ceiling that communicates with a forced air duct is referred to as a "diffuser" or sometimes as an "air register".

Almost since the availability of electrical energy, a way to improve the comfort of a room has been by use of a ceiling fan. Ceiling fans are employed throughout the world and typically consist of a motor having a vertical shaft attached to a hub from which a plurality of blades radially extend. The typical ceiling fan has relatively large blades and the fan is designed to turn the blades at a relatively low rpm so as to achieve good distribution of air in a room without producing excessive noise as is common with a fan that utilizes a small diameter blade rotated at a high rpm.

Ceiling fans are mounted so that the motor is in close proximity to the ceiling with a downwardly extending shaft to which a hub is attached at the lower end. Other ceiling fans employ motors wherein the rotor itself functions also as the hub with blade attachments secured directly to the rotor. Such fans are typically mounted so that the motor is spaced from the ceiling.

Ceiling fans are popular because they have relatively low energy requirements, are effective in air distribution and are quiet. When a room is supplied with an air diffuser for distributing forced air into a room along with a ceiling fan plus the typical light fixtures, a ceiling of a room can become very "busy", that is, cluttered with a number of different items that detract from the appearance of the ceiling. Further, when a ceiling fan is used in a room that also has an air diffuser, and where the air diffuser of the ceiling fan are spaced apart from each other, equal distribution of the forced air from the diffuser is not always effectively achieved.

It is an object of this invention to provide a combination air diffuser and ceiling fan to achieve two basic functions. First, by combining an air diffuser and ceiling fan appearance is enhanced by the decreased number of separate components attached to or extending from the ceiling. Second, and of greater importance, by combining an air diffuser and ceiling fan the effectiveness of distribution of forced air into a room is enhanced.

Others have provided improved means of air distribution combined with ceiling fans and the following previously issued United States patents provide good background information relating to the subject matter of the present invention.

| U.S. PAT. NO. | INVENTOR | TITLE |
|---|---|---|
| Re. 33,347 | Johnson III | Air-Driven Ceiling Fan |
| 571,424 | Wolfe | Heating and Ventilating Apparatus For Buildings |
| 1,333,651 | Andrassy | Ventilator |
| 2,038,347 | Cornell, Jr. | Air Conditioned Heating and Cooling System |
| 2,093,936 | Spielmann | Air Conditioning Device |
| 2,239,848 | Jackson | Air Conditioning Apparatus |
| 2,363,839 | Demuth | Unit Type Air Conditioning Register |
| 3,760,708 | Burup | Ventilating System |
| 4,191,506 | Packham | Propeller and Impeller Constructions |
| 4,326,453 | LaBoda et al | Air Transfer Device |
| 4,598,632 | Johnson III | Air-Driven Ceiling Fan |
| 4,779,671 | Dolison | Cooling, Heating and Ventilation System |
| 4,782,213 | Teal | Ceiling Fan Electrically Heating Environmental Air |
| 5,029,451 | Imaiida et al | Air Conditioning Apparatus |
| 5,097,674 | Imaiida et al | Air Conditioning Apparatus |
| 5,462,407 | Calvo | Ceiling Fan Blade and Hub Assembly |

BRIEF SUMMARY OF THE INVENTION

This invention provides a system for distributing air in a room having a ceiling, the ceiling having an opening therethrough. A plenum is mounted above the ceiling, the plenum having an open top and an open bottom. The open bottom is mounted in communication with the ceiling opening and the open top is adapted to receive connection to a source of air under pressure, such as to duct work by which heated, cooled or ventilation air is distributed.

An air diffuser is positioned within the room and in communication with the plenum open bottom. The air diffuser provides for passage of air from the plenum into the room. A fan motor is mounted within the diffuser and has a downwardly extending motor shaft with a lower portion that extends through and below or at least equal to the bottom of the diffuser.

A plurality of fan blades are affixed to and extend radially and horizontally from the motor shaft lower portion.

In some applications of the invention, a shaft is affixed to a motor rotor, the shaft having on the lower end thereof a hub to which the inner ends of blades are attached. In other types of ceiling fans the lower end of the rotor itself functions as a shaft and the inner ends of blades are attached directly to the lower end of the rotor. Under either of these conditions the motor itself is within the diffuser and the motor shaft or the lower end of the rotor is accessible for securing the inner ends of blades to it so that the blades can be rotated in a horizontal plane.

When the invention is utilized on a high ceiling in a room or on a pitched ceiling, a vertically extending tubular sleeve is secured to the plenum lower end, the sleeve extending downwardly to a diffuser in which the ceiling fan motor is housed, the motor being supported by a non-rotating shaft extending from the ceiling. The invention can be utilized on exposed duct work and without a finished ceiling.

To streamline flow of air through a diffuser, and to achieve improved air distribution, a tiered deflector cone may be installed within the diffuser.

The air diffuser may be provided with one or more control dampers that are preferably in the form of circumferential band fittings with a circular diffuser, the bands having openings therein that may be aligned or not aligned with openings in the diffuser to control air flow volume.

In another embodiment of the invention a system for distributing air through an opening in a ceiling in a room is provided in which the ceiling is supported by structural members and the air is supplied to a duct located above the ceiling. A plenum having an open top and an open bottom is mounted for support of the open top in communication with the air supply duct and the open bottom in communication with the opening in the ceiling. A vertical motor hanger has an upper end supported to the ceiling structure member and the motor hanger extending downwardly from the plenum in the preferred embodiment the plenum and the motor hanger extend coaxially in a vertical orientation. An air diffuser is positioned in communication with the plenum open bottom and provides for passage of air from the plenum into the room, the diffuser having an opening therein through which the motor hanger extends.

A fan motor is mounted to the lower end of the motor hanger, thereby positioning fan motor in the room and below the ceiling. A plurality of fan blades are affixed to and extend radially from the motor and preferably substantially horizontally. Air passing from the plenum into the room passes through the diffuser and is distributed as the fan blades are rotated by the motor.

In a further preferred embodiment, particularly adaptable when the structural members that support the ceiling are in the form of spaced apart wood joists, includes a support bar that extends through the plenum having a bracket at each end thereof that is attached by nails or screws to the spaced apart joist. The upper end of the motor hanger is supported to the bracket. In one arrangement, a junction box is affixed to the bracket, the junction box supporting the upper end of the motor hanger. The motor hanger is preferably tubular so that the electrical wiring passes through the motor hanger and into the junction box which is adapted to receive electrical connections so that electrical circuitry is provided from within the plenum to the fan motor.

In a further preferred embodiment the upper end of the motor hanger is pivotally supported to the support bar.

In a still further embodiment of the invention, a pivoted damper is positioned within an upper portion of the plenum. The pivoted damper may be spring biased to a first position, either an open or closed position, and moveable to a second position by means of a chain that extends downwardly through the grille.

The combination ceiling fan/air diffuser of this disclosure may include an air flow switch to cause the ceiling fan to be activated when air is moving through the diffuser. This system is particularly adaptable when the diffuser is a part of a forced air heating and air conditioning system that provides air flow in response to a thermostat.

A better understanding of the invention will be obtained from the following description of the preferred embodiments and the claims, taken in conjunction with the attached drawings.

DESCRIPTION OF THE DRAWINGS

FIG. 6 is an alternate embodiment of the invention showing a type of fan motor wherein the blades are secured directly to the lower end of the fan motor. An air switch is employed in the air flow path to actuate in response to air flow such as provided when the diffuser/ceiling fan unit is a part of an automatic forced air heating and/or air conditioning system.

FIG. 7 is an elevational, partial cross-sectional view of an air diffuser/ceiling fan To combination such as shown in FIG. 6 but, in addition, disclosing the use of a deflector cone within the diffuser to improve the flow of air out of the diffuser.

FIG. 8 is an isometric view of the deflector cone as employed in FIG. 7.

FIG. 9 is like FIG. 7 but shows the addition of slip bands within the diffuser that provide damper control of air discharged from the diffuser.

FIG. 10 is an isometric view of a short length tubular shaped slip band that functions as a damper in FIG. 9.

FIG. 11 is an isometric view of a short frusto-conical shaped slip band that is one of the dampers employed in FIG. 9.

FIG. 12 is a simplified electrical circuit showing a way of using an air switch in conjunction with the normal on/off switch for automatically turning the fan on when air is flowing through the plenum.

DETAILED DESCRIPTION OF THE PREFERRED EMBODIMENTS

Figure 2:
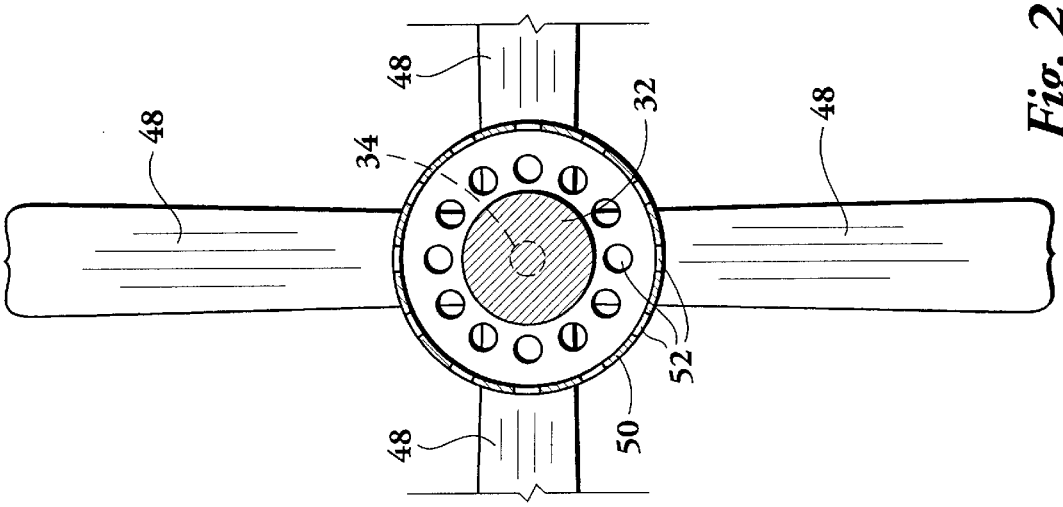
FIG. 2 is a fragmentary horizontal cross-sectional view taken along the line 2-2 showing the relationship between the fan motor and the diffuser.
Figure 1:
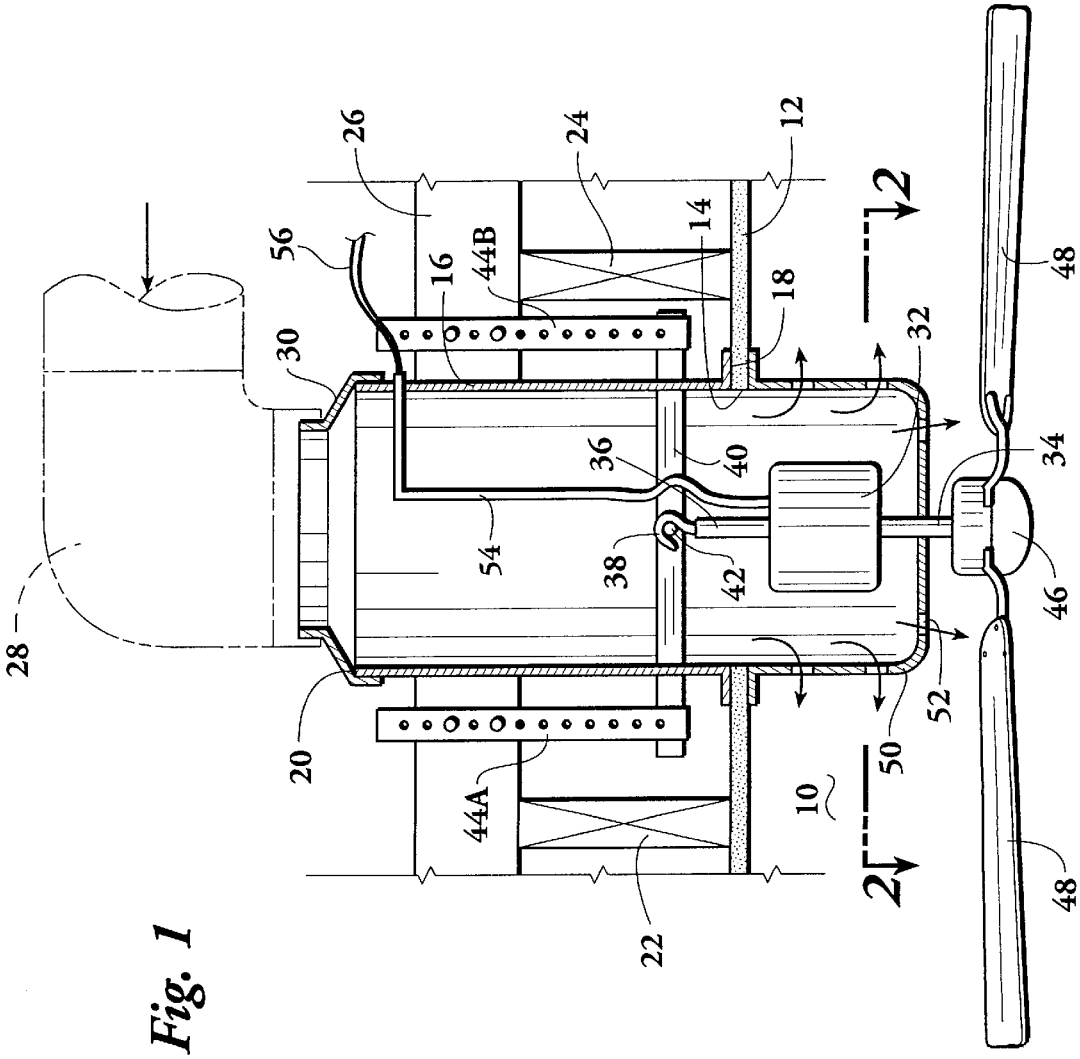
FIG. 1 is an elevational cross-sectional view of one means of employing the system of this invention showing, in cross-section, a ceiling of a room above which a plenum is mounted, the plenum having communication with an opening in the ceiling. Below the ceiling an air diffuser is secured in communication with the ceiling. A fan motor is mounted within the air diffuser. Extending from the fan motor is a shaft connected to a hub from which extends, in a radial pattern, horizontal fan blades. Air is diffused from a forced air system connected to the plenum. Simultaneously, the ceiling fan aids in distribution of the air within the room. Thus, a single unit provides both forced air diffusion and a ceiling fan for esthetic and economic advantages and for better distribution of the forced air entering the room.

Referring to the drawings and first to FIGS. 1 and 2, a first embodiment of the invention is illustrated. FIG. 1 shows a cross-section of a system for practicing the invention and for providing distribution of air into the interior of a room 10 having a ceiling 12, the ceiling having an opening 14 therein. Opening 14 is typical of means by which forced air can be moved into room 10, forced air being, as an example, warm air for heating the room, cool air for cooling the room or ambient air for providing circulation. The typical of forced air heating or air conditioning system includes a plenum 16, which also may be called a "ceiling boot", having a lower end 18 and an open upper end 20, the lower end 18 communicating with opening 14 in ceiling 12.

In modem day construction ceiling 12 is typically supported to spaced apart ceiling joists 22 and 24, usually made of wood, the ceiling 12 being secured to ceiling joist 22 and 24 by a cross member 26.

A forced air duct 28 is positioned above ceiling 12 and connects to plenum 16 by means of an adapter 20 which may be referred to as a "boot cap adapter".

The system described to this point is typical of means of distributing forced air into a room by providing connection between a forced air duct 28 and an opening 14 in a ceiling. In the usual heating and air conditioning system a diffuser or register is secured to ceiling 12 within room 10 to cover the opening 14 for the dual function of making the opening more esthetically acceptable plus improving the distribution of air forced into the room. This invention includes the elements which will now be described. Supported within the air path of opening 14 formed in ceiling 12 is a fan motor 32 having a shaft 34 extending vertically downwardly therefrom. A motor mount 36 extends upwardly from motor 32 to a hook 38. A hanger bar 40 has a pin 42 that is received by hook 38. The outer ends of hanger bar 40 are secured to the lower ends of straps 44A and 44B that are attached to cross member 26.

Secured to the lower end of shaft 34 is a hub 46 and extending from the hub are a plurality of fan blades 48. FIG. 2 shows that the fan has four blades which is typical although the number of blades can vary, usually from 3 to 6. Blades 48 are relatively large, being typically two to three feet in length, and are sometimes referred to as "paddles". The advantage of the large blades is that effective air distribution can be obtained even though the blades are rotated at a relatively low rpm to thereby move relatively large quantities of air at minimum noise.

Secured to the bottom of ceiling 12 and surrounding motor 32 is a diffuser 50, which may also be referred to as a "grille". Diffuser 50 may be made of thin metal or plastic and has a plurality of openings 52, some of the opening being the sidewall and others, optionally, in the bottom of the diffuser.

A conduit 54 containing wires 56 to provide means of conveying electrical energy to motor 32, it being understood that the specific means of passing electrical energy carrying wires 56 through plenum 16 and for connection to motor 32 is not a part of this invention and can vary considerably depending upon the electrical code of the location where the system is employed.

The system illustrated in FIGS. 1 and 2 has several advantages over forced air distribution systems in use today. First, by providing a diffuser 50 having means of connecting forced air to it along with an integral ceiling fan combines two functions into one unit, thereby reducing ceiling clutter. Second, this arrangement affords an opportunity for reducing expenses of installing both a forced air system diffuser and a ceiling fan in a room. Third, and of equal or greater importance, is the advantage of providing improved distribution of air forced into room 10 from the air heating and/or air conditioning system. By locating diffuser 50 centrally above fan blades 48, air passing into room 10 is very effectively, quickly and equally distributed. Since diffuser 50 is centrally positioned with respect to the fan, air passing into the room through the diffuser is equally distributed throughout the room by rotating blades 48.

Another significant advantage of the system of FIG. 2 is the placement of fan motor 32 within the confines of diffuser 50. Such arrangement enables the diffuser to function as the esthetic covering for the fan motor 32, effectively cools the fan motor by passing by the diffusion of air from the forced air system past the motor and reduces height requirements as compared to a system that places an air diffuser and a ceiling fan motor in a serial relationship, that is, compared to a system wherein a ceiling fan motor is positioned below a diffuser.

Figure 3:
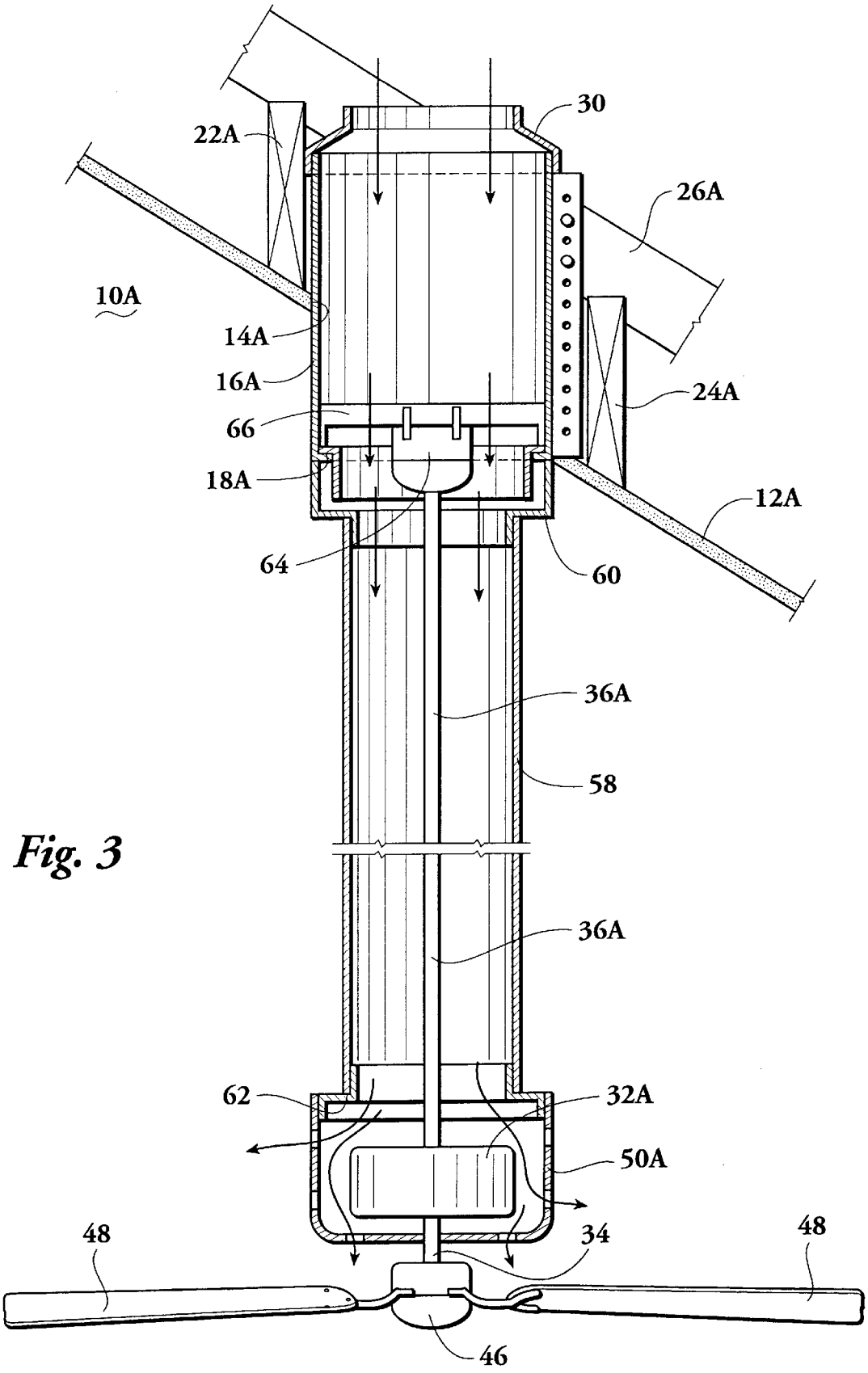
FIG. 3 is an elevational cross-sectional view of an alternate embodiment of this invention illustrating the method in which the system is employed in a room having an unusually high ceiling or a pitched ceiling. In this embodiment a plenum is in communication with an opening in the ceiling and with an elongated vertically extending tubular sleeve. An air diffuser is attached to the lower end of the tubular sleeve. A fan motor is supported within the diffuser.

Referring to FIG. 3 an alternate embodiment of the invention is shown for use in a room 10A that has a high ceiling or a pitched ceiling 12A. Rafters 22A and 24A support ceiling 12A and a cross member 26A is provided. A plenum 16A extends partially through the opening 14A in ceiling 12A and receives a boot adapter 30 as described with reference to FIG. 1. A forced air duct connects to boot adapter 30 but is not illustrated in FIG. 3.

To reduce the elevation of an air diffuser and a ceiling fan used in conjunction therewith, a vertically extending tubular sleeve 58 is employed, the upper end thereof being affixed to an adapter 60 that connects to the lower end 18A of plenum 16A. Tubular sleeve lower end 62 receives diffuser 50A that surrounds fan motor 32A, the fan motor being supported by an elongated motor mount 36A which is attached at its upper end to a motor mount support 64 which, in turn, is secured to a cross-bracket 66. Cross-bracket 66 is secured to the interior of plenum 16A. The arrangement of FIG. 3 includes a plenum 16A having more structural integrity than is required merely for the passage of air therethrough since it must support tubular sleeve 58, fan motor 32A and blades 48. The method of supporting fan motor 32A by means of motor mount 36A and motor mount support 64 is by example only as other means can be devised for supporting the weight of the motor, such as by physically securing the upper end of motor mount 36A to the building structural components, and therefore the specific structural arrangement for supporting the fan motor is not an integral part of this invention. What is important about the invention is the concept of integrating fan motor 32A and diffuser 50A for the plurality of functions as has been previously described to achieve improved esthetics, improved air distribution and economy.

Figure 5:
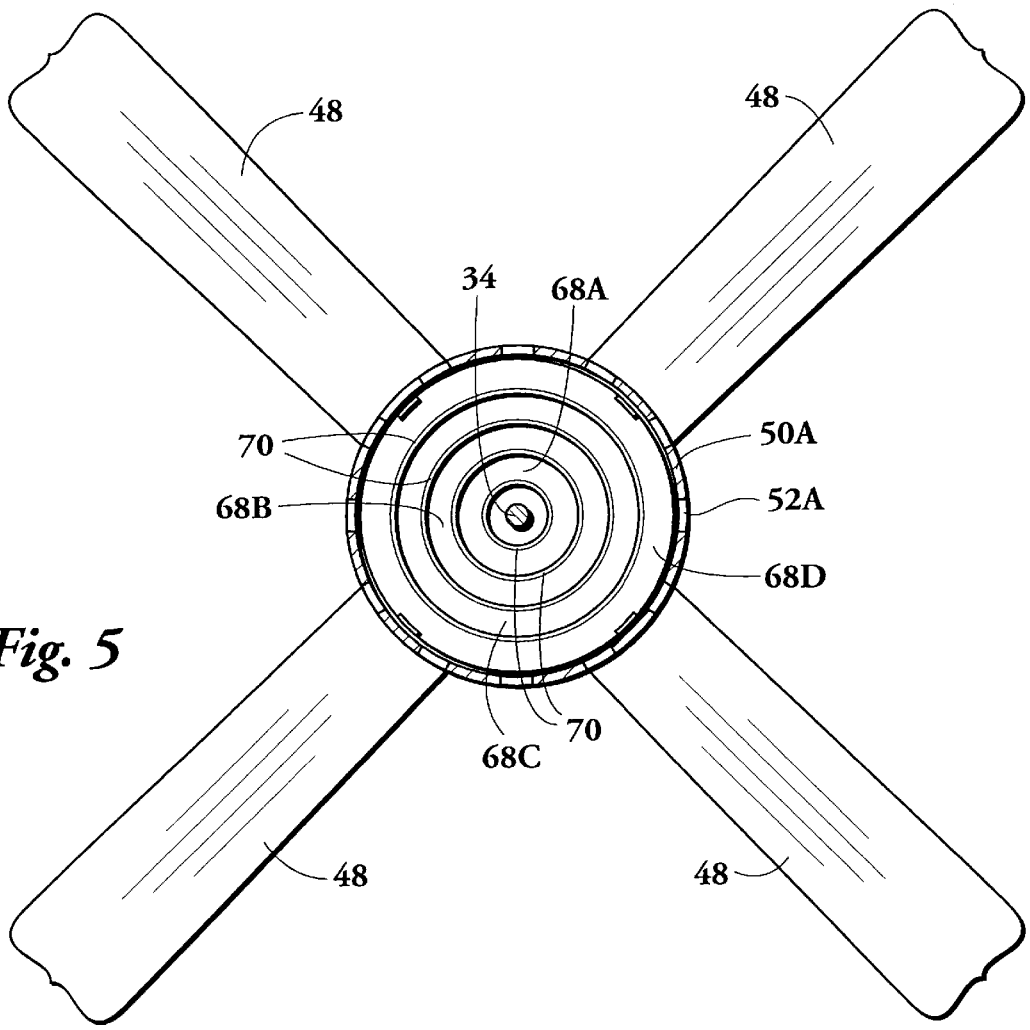
FIG. 5 is a horizontal cross-sectional view taken along the line 5—5 of FIG. 4.
Figure 4:
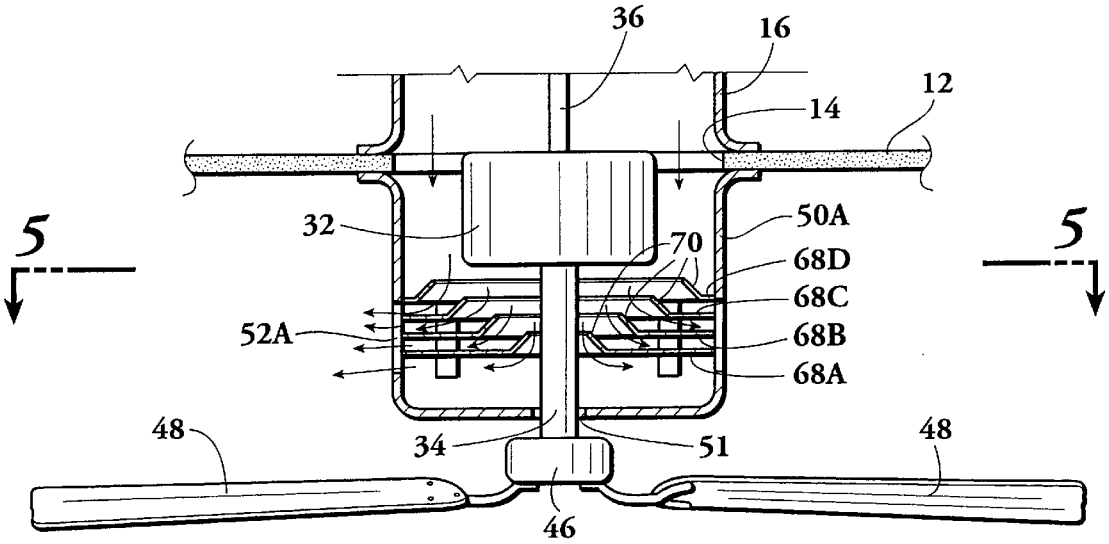
FIG. 4 shows an elevational cross-sectional view of another alternate embodiment of the invention, similar to the embodiment of FIG. 1, but wherein the air diffuser has internal baffles to more effectively horizontally distribute the air enumerating from the plenum.

Referring now to FIGS. 4 and 5 an additional embodiment of the invention is shown in which horizontal ceiling 12 has an opening 14 therein as previously detailed. Communicating with opening 14 is shown a fragmentary lower portion of a plenum 16. A fan motor 32 is supported within the interior of a diffuser 50A, the diffuser being secured to ceiling 12 in communication with opening 14. Motor 32 is supported by a motor mount 36 as was described with reference to FIGS. 1 and 2, the motor having a shaft 34 extending therefrom, the shaft extending out through an opening 51 in the bottom of diffuser 50A. Surrounding motor shaft 34 and within the interior of diffuser 50A are a plurality (four being shown) of air diverters 68A through 68D. Air diverters 68A through 68D are each generally positioned in a horizontal plane and each has a central opening therein that receives shaft 34. The portions of the air diverter adjacent the shaft are upwardly inclined at 70 to assist in moving air from a vertically downward direction into a horizontal component as illustrated by the arrows. Thus air diverters 68A–68D serve to cause a more radial distribution of air flowing out the diffuser 50A.

Another embodiment of the invention is illustrated in FIG. 6 which illustrates plenum 16B shaped differently than those of FIGS. 1 and 3. Plenum 16B is supported directly to ceiling joist 22B and 24B by flanges 72. Boot cap adapter 30A is shown to be integrally formed with plenum 16B. In this embodiment motor 32B is illustrated as being of the type wherein blades 48 are secured by blade brackets 74 directly to rotor 76. This system permits a tubular extension 78 which is non-rotatably secured to motor 32B to extend out through rotor 76 to which a housing 80 is attached. Housing 80 may be used to house switches such as for controlling the speed or direction of rotation of motor 32B, or housing 80 can be used to support a light fixture (not shown) so that a light may be combined with the air diffuser and ceiling fan. The use of lights with ceiling fans is well known, therefore the use of lights with the system of this invention is considered to be a part of the invention, it being understood that to the practitioner skilled in the art the use of a light fixture below a ceiling fan having a non-rotating extension 78 is a standard technique.

In the embodiment of FIG. 6 the motor mount 36A is secured to a bracket 82 which in turn is attached to a brace 84 that extends within plenum chamber 16B between ceiling joist 22B and 24B illustrating another way of supporting a motor within a diffuser.

In the embodiment of FIG. 6 the diffuser of 50A is shown to have triangular openings 52A in the upper portion and round openings 52B in the lower portion illustrating the fact that the esthetic arrangement of diffuser 50A can be changed considerably. Any diffuser that provides the combination of means for passing air under pressure out through the diffuser while housing a motor 52B is within the scope of the system of this invention.

In FIG. 6, an electrical junction box 86 is secured to the exterior of plenum chamber 16B, with a conduit 88 extending from junction box 86 to motor bracket 82 as a means of enclosing conductors (not seen) to supply electrical energy to motor 32B.

The system described herein attains all of the objectives as set forth in the summary of the invention and provides an improved system for installing a ceiling fan in combination with an air diffuser in a room to achieve a plurality of advantages, namely to achieve better distribution of air received from a forced draft system, to provide improved esthetics and economy.

FIG. 6 shows an air switch 90 mounted on plenum 16B, the switch having an elongated reed 92 extending out to a small target 94. Target 94 is held adjacent the center of plenum 16B to respond to the movement of air through the plenum. When air movement occurs, switch 90 is closed.

A typical circuit is illustrated in FIG. 12. One pole of motor 32B is connected to a conductor 96 that is typically a ground or neutral wire. Switch 90 is connected between motor 32B and a hot wire 98 in series with an on/off switch 100. When switch 100 is closed, motor 32B will be turned on when switch 90 detects flow of air through plenum 16B. Switch 100 can be mounted on housing 80 or can be wall mounted.

In parallel with switches 90 and 100 are switches 102 and 104. Switch 102 is a wall mounted on/off switch that is in series with motor 32B. On/off switch 104 is preferably located on housing 80 and is connected between switch 104 and hot wire 98, that is, switch 104 is in series with on/off wall mounted switch 102. When both switches 102 and 104 are closed motor 32B will be turned on whether or not air is flowing through plenum 16B.

The circuit works in the following fashion. When first wall switch 100 (preferably mounted on housing 80) is turned on, motor 32B will be energized when air movement is detected by air switch 90. This means that if the heating and air conditioning system is actuated and forced air is moving through duct 28 and thereby plenum 16B, the fan motor 32B will be actuated to distribute air that is being passed into the room. When air flow movement stops, then fan motor 32B is de-energized. In other words, with switch 100 turned on the system for distributing air in the room using the combination air diffuser/ceiling fan will operate the ceiling fan anytime that air is being moved into the room, whether for heating or for cooling, to improve the air distribution and the fan will automatically be turned off when no air is being moved into the room. On the other hand, if second wall switch 102 is turned on, fan motor 32B is energized if switch 104, preferably located on housing 80, is also turned on. Switch 102 is a wall switch and is only for easy accessibility for the occupants to turn the fan on. Switches 102 and 104 work independently from switches 90 and 100.

FIG. 7 shows an alternate embodiment of the arrangement of the air diffuser/ceiling fan combination of FIG. 6 by the inclusion of a generally conically shaped air deflector 106. This air deflector, which is shown isometrically in FIG. 8, is preferably formed of a thin material, either metal or plastic, and is generally conical shaped but in the illustrated and preferred embodiment, is provided with a sequence of tiers that reduce step wise in diameter. The air deflector 106 has an open bottom 108 and a smaller diameter opening 110 in the top that receives the motor mount 36A as seen in FIG. 6.

A function of air deflector 106 is to improve and streamline the air flow passing from plenum 16B through air diffuser 50A. Deflector 106 helps change the direction of air from a downward direction as it passes out of plenum 16B to a more radial and horizontal direction to be more effectively distributed by fan blades 48.

FIG. 9 shows an additional embodiment of the invention that, in addition to the inclusion of air deflector 106 includes provisions for regulating the volume of air passing out through the diffuser. In this embodiment diffuser 50A has a cylindrical sidewall 112 (seen best in FIG. 7) that has a plurality of openings 114 therein. Positioned within the interior of diffuser 50A is a short length tubular slip band 116 that is shown isometrically in FIG. 10. The slip band 116 is rotatable relative to diffuser sidewall 112 and the slip band has a plurality of spaced apart openings 118 therein. Extending from slip band 116, as seen in both FIGS. 9 and 10, are radial tabs 120 that move in slots (not seen) in the diffuser sidewall 112. Slip band 116 can thus be rotated to either align openings 118 with openings 114 in diffuser sidewall 112 or to miss-align such openings. In this way the volume of openings in the diffuser sidewall 112 is controllable to thereby control the amount of air discharged through the diffuser.

As shown in FIGS. 7 and 9, the diffuser sidewall further has a bottom portion defined by a frusto-conical sidewall 122 that has openings 124 therein. Rotatably supported within the diffuser lower portion and in contact with the internal frusto-conical surface of sidewall 122 is a frusto-conical shaped slip band 126 that has openings 128 therein. The frusto-conical slip band 126 and the openings therein are best seen in the isometric view of FIG. 11. Tabs 130 extend from frusto-conical slip band 126 and through slots (not seen) in the frusto-conical sidewall 122 so that slip band 126 may be positioned to align or dis-align the openings therein with the openings in the sidewall to control the amount of air discharged from diffuser 50A. Slip bands 116 and 126 could be formed as a single unit and as such would function in the same way to open or close openings in both the upper and lower portion of the diffuser sidewall. By the use of the slip bands, the quantity of air being discharged into a room as it flows from duct work 28 and plenum 16B into the room can be controlled by the room occupants.

Figures 13, 14A, 14B:
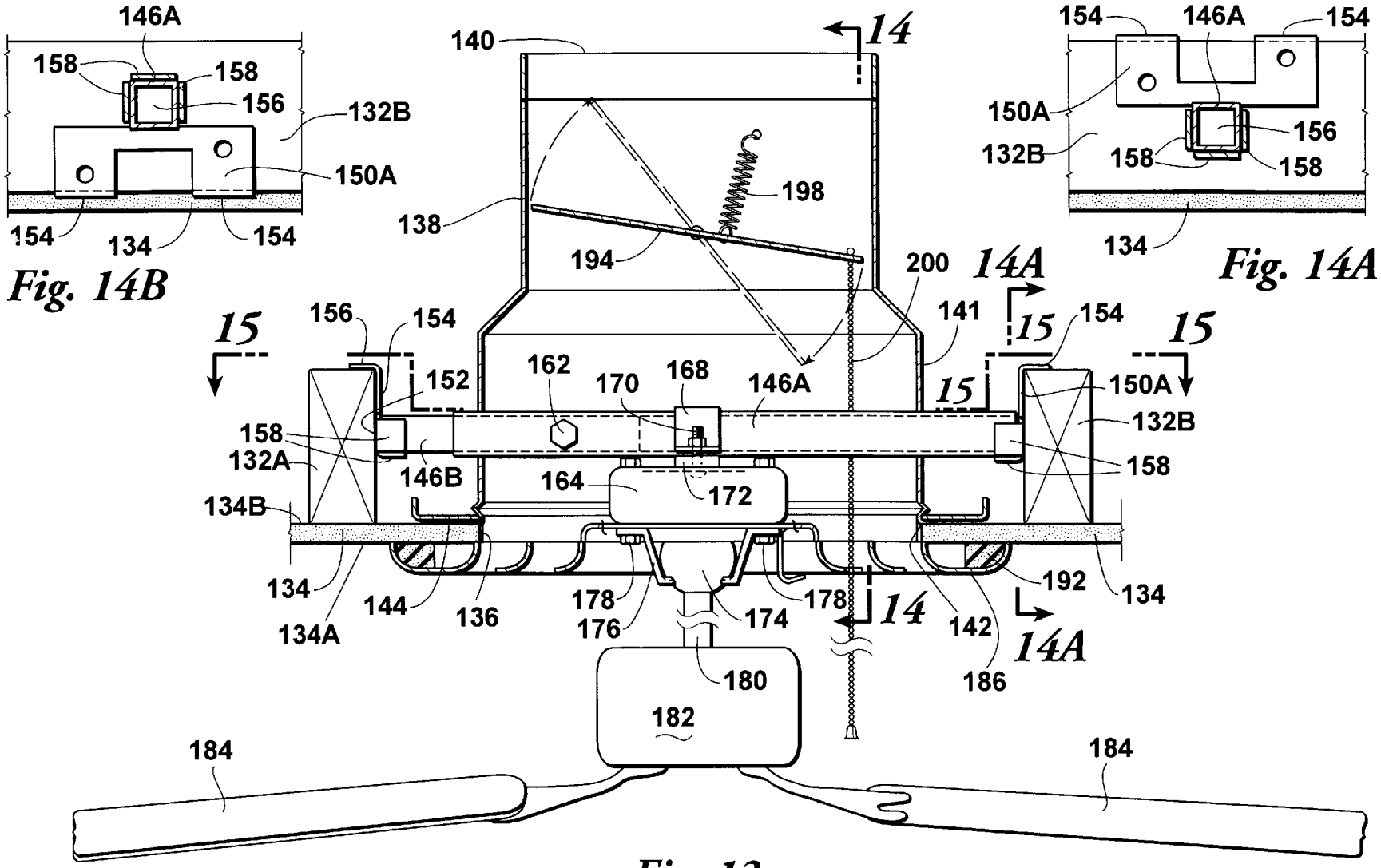
FIG. 13 is an elevational cross-sectional view of a ceiling in which the ceiling is supported by a structural members that are in the form of spaced apart wood joists. A plenum is supported with the lower open end thereof in communication with an opening in the ceiling. A support bar extends through the plenum and is attached, by means of brackets, to the ceiling joist. A motor hanger is secured to the support bracket and extends downwardly through an opening in a diffuser to support a fan motor. Blades extend from the fan motor to distribute air that passes into the room from the plenum, and through the diffuser.
FIG. 14A is a partial cross-sectional view taken along the line 14A—14A of FIG. 13 showing a type of bracket attached to a wood ceiling joist to support one end of a support bar. In the arrangement of FIG. 14A, the bracket is partially secured to the upper surface of the ceiling joist.
FIG. 14B is a view as in FIG. 14A except that the bracket has a portion that is secured to the lower surface of the ceiling joist to which it is attached.

Referring to FIGS. 13 through 16 slightly altered embodiments of the invention are illustrated. FIG. 13 shows a cross-sectional view of a system for mounting a fan in a ceiling in which the ceiling is supported by structural members indicated as wood joists 132A and 132B. The ceiling could be supported by other types of structural members either formed of wood or metal. Affixed to the wood joists is a ceiling material such as sheet rock 134 with an interior surface 134A that is the internal ceiling surface for a room. Ceiling joists 132A and 132B are equally spaced apart and in most rooms are horizontal, however, the ceiling joists may be inclined at an angle to the horizontal.

Formed in sheet rock 134 is an opening 136 of the type used to permit the passage of forced air, for heating, cooling or ventilation into a room. Positioned in communication with opening 136 is a plenum 138 that has an open top 140, a sidewall 141 and an open bottom 142. The open bottom 142 being in communication with ceiling opening 136. Plenum open top 140 is configured to receive a duct, not shown in FIGS. 13 through 16 but of the type shown as duct 28 in FIG. 1, such duct serving to provide a source of forced air for heating, cooling or ventilation.

Figure 15:
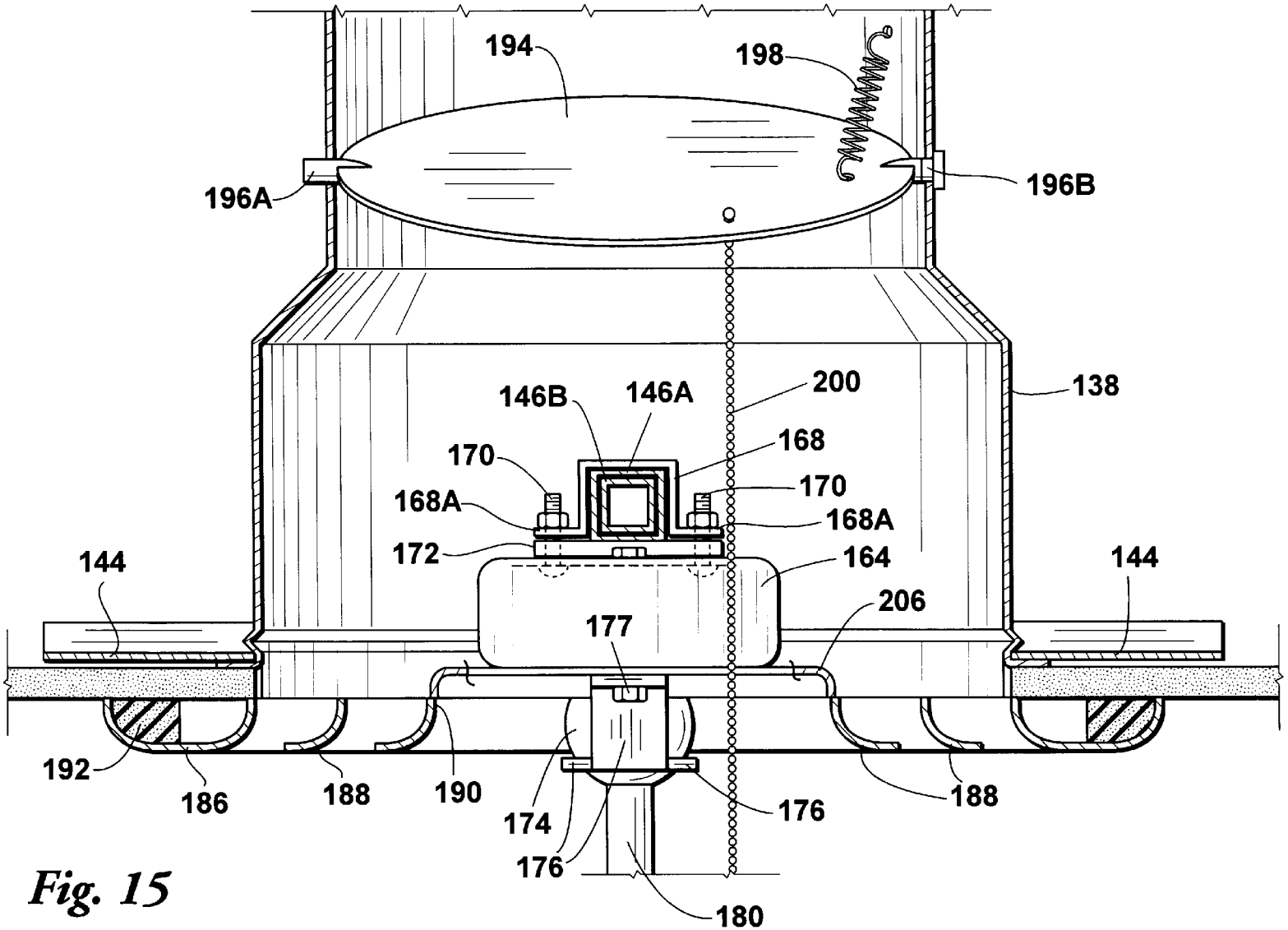
FIG. 15 is an elevational cross-sectional view taken along the line 14—14 of FIG. 13. The view is slightly enlarged compared to FIG. 13 and shows more detail of the relationship between the support bar and a junction box which, in turn, supports the upper end of the motor hanger and shows further detail of the relationship between a plenum, the motor hanger and the grille by which air passes from the plenum into a room to be distributed by a fan secured to the lower end of the motor hanger.
Figure 16:
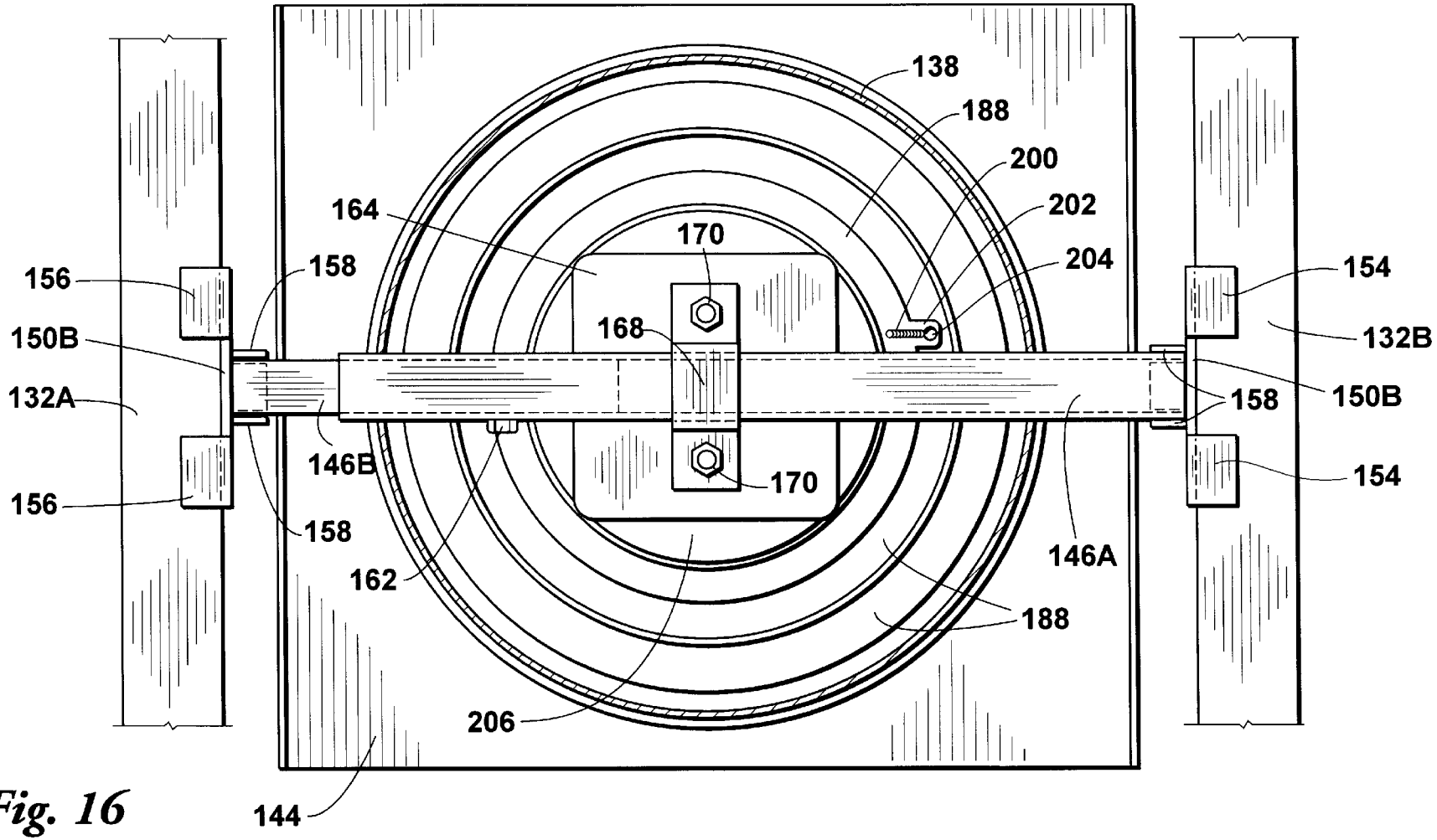
FIG. 16 is a horizontal cross-sectional view taken along the line 15—15 of FIG. 13 showing the relationship between the plenum, the support bracket that is attached to opposed wood ceiling joists and a square junction box affixed to a support bracket.

Plenum 138 has, at the lower end thereof which provides opening 142 a planar bottom plate 144, seen best in FIG. 16 but shown in cross-section in FIGS. 13 and 15. The bottom plate serves to fit against the upper surface 134B of sheet rock 134 to assist in ceiling plenum bottom opening 142 to ceiling opening 136.

Extending through the sidewall 141 of plenum 138 is a hanger bar that, in the illustrated embodiment is formed in two telescoping portions, that is, an outer hanger bar portion 146A and an inner hanger bar portion 146B. A first end 148 of outer hanger bar portion 146A is supported by a first clip 150A that is secured to ceiling joist 132B. In like manner, a second clip 150B supports a second end 152 of the hanger bar inner portion 146B to ceiling joist 132A. Clip 150A as seen in FIG. 13 and FIG. 14A has a vertical portion that lies flat against the vertical surface of ceiling joist 132A and horizontal portions 154 that in FIG. 14A lie on the top edge of ceiling joist 132A. The vertical portion 150A has an integral vertical extension 156 with integral horizontally perpendicularly extending tang portions 158. The tang portions 158 extend out to receive hanger bar 146A therein.

The opposite clip 150B is constructed the same, that is, having a tang portion 158 that extend out to receive inner hanger bar 146B as seen in the left hand view of FIG. 13.

While in FIG. 13 the clip is supported on the top of the ceiling joist 132A and 132B, the clip can equally as well be designed to be positioned on the bottom edge of the hanger joist as shown in FIG. 14B. The clip designed for use for the horizontal portions extend across the bottom of the ceiling joist is different only in that one of the tangs 160 is welded to the horizontal portion 150A to allow the hanger bars to rest on the welded portion.

The specific arrangement of the clips 150A and 150B can be changed considerably. For instance, it is not imperative that the clips have a portion that extend either on the top or bottom edge of the joist since securely nailing horizontal portions of the clip to the vertical faces of the joist can serve to adequately support the hanger bar and plenum. Further, rather than extend around the outer end of portions of the hanger bars, clips can be designed to have protruding portions that extend within the interior of the hanger bars since the hanger bars are mounted by telescopically extending the portions of the hanger bars to adapt for spacing between adjacent ceiling joists.

After the hanger bar portions 146A and 146B are telescopically extended to engage clips affixed to opposed ceiling joists, a bolt 162 that thread ably extends through outer hanger bar 146A can be tightened to maintain the extended lengths of the support bars.

A junction box 164 is supported to the hanger bars 146A/146B so as to centrally position the junction box with respect to opening 136 in the ceiling. The junction box may be attached by means of a U-shaped bracket 168 that extends over hanger bar outer portion 146A as shown in FIG. 15. Bracket 168 has horizontally extending leg portions 168A that receive bolts 170 that extend through the junction box 164 to attach the junction box to bracket 168. A spacer bar 172 is employed between junction box 164 and hanger bar 146A to strengthen the installation, however, the use of the spacer bar 172 is optional.

Secured to the lower end of junction box 164 is a pivot housing 174, shown attached by a bracket 176 held to the junction box by bolts 178. A pivoting support member (not seen) is received within pivot housing 174 that is attached to the upper end of a vertical motor hanger 180 that typically is a pipe that can be of variable length to adjust the height of a ceiling fan above a floor surface, the floor surface not being seen. Motor hanger 180 has secured to the lower end of it, a fan motor 182 and radially extending from fan motor 182 are a plurality, usually three to six blades 184.

Pivot housing 174 allows a privation of motor hanger 180 with respect to the junction box to accomplish two purposes, the first being to allow motor hanger 180 to extend generally vertically downward from the junction box and second, to allow a slight wobble of the fan motor 182 as the fan blades rotate to permit such slight wobble if any unbalance in the blades exist.

Affixed to the lower surface 134A of sheet rock 134 is an air diffuser or grille 186. Grille 186 has annular diverter veins 188 shaped to direct and diffuse air flowing into the room downwardly from plenum 138. The diverter veins 188 are secured to the outer ring of grille 186 by horizontal small diameter metal bars (not seen in the drawings) so that the grille is a unitary item as installed. The diverter veins are arranged to provide an internal opening 190 through the grille that is sufficiently large to receive bracket 176 to permit the fan motor support system to be attached to the lower end of junction box 164 after the junction box has been installed in position within the plenum. Grille 186 can be attached to the sheet rock lower surface 134A such as by adhesive or by the use of screws (not shown). When adhesive is employed, a plastic filler ring 192 to provide a surface to receive adhesive for ease in mounting the grille to the ceiling.

Pivotally supported within the upper portion of plenum 138 is a damper 194 that, as seen in FIG. 15, is pivotally attached by coaxial pivot shafts 196A and 196B. Damper 194 is configured, in one position, to substantially close the flow of air through the damper and in another position to substantially fully open the damper for the passage of air. A spring 198 urges the damper to either a fully open or a fully closed position. In the illustrated arrangement, spring 198 urges the damper to a fully closed position although it can be seen that the spring can be reoriented to maintain the damper in a fully open position. A chain 200 has one end attached to the damper and the other end extending through grille 186, that is, extending between the diverter veins 188 of the grille. As best seen in FIGS. 13 and 16 one of the diverter veins 188 has an extending tab portion 202 with an opening therein that receives chain 200. The opening in the tab portion 202 is designed such that in one position of the chain within the opening, the chain moves freely through the opening so as to permit a user to open or close the damper but in another and smaller diameter portion of the opening 204 the chain is held in a fixed position with respect to the diverter vein. In this way, a user can adjust damper 194 to control the volume of air flowing from the plenum, through the grille 186 and into the room.

The diverter veins 188 as shown in the illustrated embodiment are configured to direct air more or less downwardly and radially outwardly from the opening in the ceiling. This is by illustration only. The diverter veins could be configured to direct air only straight downwardly from the opening if desired as with a perforated or gride face cores as examples.

Reference has been made to the opening 190 formed in grille 186 to facilitate the installation of the fan system to a junction box 164 positioned within plenum 138. If desired, a filler plate 206 can be attached, as illustrated, to the bottom of junction box 164 to close or at least substantially close opening 190. The use of a filler plate is optional. A function of the filler plate is to improve the visual impact of the system for distributing air through a ceiling into a room by closing off direct sight through opening 190 into the interior of plenum 138.

The system for distributing air through an opening in a ceiling into a room as illustrated and described herein provides a system that substantially reduces the clutter in the ceiling of a room by affording the mounting of a ceiling fan in conjunction with an air distributing grille and further provides for improved means of more effectively distributing air in a room, whether the air is intended to heat, cool or ventilate the room by the combined advantages of a forced air distribution system augmented by a ceiling fan that is centrally positioned with respect to the flow of air into the room. The system provides for an inexpensive and easy way of mounting a plenum to ceiling structural members, such as ceiling joists, in a way to provide for the easy connection of a duct work to the plenum and for easy attachment of an air diffuser grille combined with an easy to install and effective system for supporting a ceiling fan with respect to an opening in the ceiling and a plenum positioned to convey air through the opening.

The use of a junction box 164 is optional. It can be seen that bracket 176 that holds the fan pivot housing 174 could be attached directly to bracket 168 that is secured to hanger bar 146A. The elimination of the use of a junction box 164 as part of the support structure could be accomplished by locating a junction box elsewhere with conductors extending from a remotely located junction box into the upper open end of the tubular motor hanger 180 so that electrical continuity is thereby provided with fan motor 182. Further, while not shown, a light fixture can be affixed to the bottom end of fan motor 182—a standard procedure with ceiling fans and conductors for such light fixture passes through motor hanger 180 directly into junction box 164 or can be conveyed to a remotely located junction box. In other words, the system for distributing air through an opening in a ceiling into a room of this invention does not include the mandatory use of a junction box as an integral part of the fan motor support structure.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A system for distributing air through an opening in a ceiling into a room, the ceiling being supported by paralleled, spaced apart horizontal structural members, the air being supplied through an air supply duct located above the ceiling, comprising:

a plenum having a top, a vertical sidewall, an inlet opening and an open bottom and being mounted for support between the spaced apart horizontal structural members with the inlet opening in communication with the air supply duct and the open bottom in communication with the opening in the ceiling;

a horizontal support bar extending centrally through said plenum and through said sidewall and intermediate said plenum top and bottom, the support bar being attachable at opposed ends thereof to the structural members;

a vertical motor hanger having an upper end supported to said horizontal support bar within said plenum, the motor hanger extending downwardly from said plenum and into the room;

an air diffuser positioned in communication with the opening in the ceiling and thereby in communication with said plenum open bottom and providing for passage of air from said plenum into the room, the diffuser having an opening therein through which said motor hanger extends; and a fan motor mounted to a lower end of said motor hanger and within the room.

2. A system for distributing air into a room according to claim 1 including:

an electrical junction box supported to said horizontal support bar within said plenum, said motor hanger being tubular and having an upper end in communication with the junction box.

3. A system for distributing air through a ceiling into a room according to claim 2 wherein said motor hanger and said junction box provide a passageway for conductors extending to said motor.

4. A system for distributing air through a ceiling into a room according to claim 1 including:

an air movement detector switch mounted with respect to said plenum, the switch responding to close a circuit when air flows through said plenum, the air movement detector switch being connected with said motor whereby said motor is energized when air flows through said plenum to ensure improved distribution of air in the room.

5. A system for distributing air through a ceiling into a room according to claim 1 wherein said motor hanger upper end is pivotally supported to said support bar.

6. A system for distributing air through a ceiling into a room according to claim 1 including a controllable damper positioned within said plenum.

7. A system for distributing air through a ceiling into a room according to claim 6 wherein said damper is positioned above said support bar.

8. A system for distributing air through a ceiling into a room according to claim 6 wherein said damper is spring loaded to a first position and may be secured in a second position by a chain extending through said grill.

9. A system for distributing air through a ceiling into a room according to claim 1 wherein said support bar is of adjustable variable length.

10. A system for distributing air through a ceiling into a room according to claim 9 wherein the ceiling structural members are spaced apart wood joists and including:

first and second brackets attachable to said joist by nails or screws, opposed ends of said support bar being secured by the brackets.

* * * * *